US007559211B2

(12) United States Patent
Revlett et al.

(10) Patent No.: US 7,559,211 B2
(45) Date of Patent: Jul. 14, 2009

(54) AIR TOWER WITH HEAT TRAP COMPARTMENT FOR TOP MOUNT FREEZER REFRIGERATOR

(75) Inventors: Johnny R. Revlett, Robards, KY (US); Matthew P. Deig, Evansville, IN (US); Daryl L. Reuter, Evansville, IN (US); Matthew W. Hartmann, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 294 days.

(21) Appl. No.: 11/195,102

(22) Filed: Aug. 2, 2005

(65) Prior Publication Data

US 2007/0028643 A1 Feb. 8, 2007

(51) Int. Cl.
*F25D 17/04* (2006.01)

(52) U.S. Cl. ..... 62/407; 62/186; 62/187; 62/90; 62/408; 62/419; 62/440; 62/441

(58) Field of Classification Search ..... 62/186, 62/187, 90, 407, 408, 440, 441, 419
See application file for complete search history.

(56) References Cited

U.S. PATENT DOCUMENTS

| | | | | |
|---|---|---|---|---|
| 2,511,419 | A | 6/1950 | Smith | |
| 3,727,419 | A | 4/1973 | Brightmann et al. | 62/155 |
| 4,920,765 | A | 5/1990 | McCauley et al. | 62/408 |
| 5,369,963 | A | 12/1994 | Pickles et al. | 62/408 |
| 5,735,138 | A | 4/1998 | Park et al. | 62/455 |
| 5,802,867 | A * | 9/1998 | Kang | 62/408 |
| 5,826,442 | A | 10/1998 | Lee | 62/283 |
| 6,739,146 | B1 | 5/2004 | Davis et al. | 62/155 |
| 2004/0144128 | A1 * | 7/2004 | Junge et al. | 62/441 |
| 2005/0126206 | A1 * | 6/2005 | Oh | 62/407 |

* cited by examiner

*Primary Examiner*—Frantz F Jules
*Assistant Examiner*—Azim Rahim
(74) *Attorney, Agent, or Firm*—Kirk Goodwin; Michael D. Lafrenz

(57) ABSTRACT

An air tower is provided for a refrigeration appliance that has a first cooled compartment and a second cooled compartment. The air tower has a diffuser section with a plurality of vent outlets to communicate with the first cooled compartment. A central duct section is defined by walls extending away from the diffuser section. An outlet is located at an end of the central section opposite the diffuser section to communicate with the second cooled compartment. A heat trap compartment is formed along one of the walls defining the central duct section. The heat trap compartment may communicate with a defrost heater.

4 Claims, 3 Drawing Sheets

AIR TOWER WITH HEAT TRAP COMPARTMENT FOR TOP MOUNT FREEZER REFRIGERATOR

BACKGROUND OF THE INVENTION

The present invention relates generally to air towers used in refrigeration appliances with a top mount freezer.

A common air circulation arrangement for refrigeration appliances with top mount freezers is to have an air tower located generally at the rear of the refrigeration compartments to guide a flow of chilled air into an upper and a lower refrigeration compartment. For example, U.S. Pat. No. 5,369,963 discloses an air tower construction for use in a top mount freezer refrigeration appliance. Air towers are also disclosed in U.S. Pat. Nos. 4,920,765 and 5,735,138. Air is directed over an evaporator to chill the air, usually well below 0° C. (32 ° F.) and the chilled air is directed into the air tower to diffuse into the freezer compartment and into the fresh food compartment, at a determined ratio, so that a temperature differential is maintained in the two compartments. Since the air in the tower is usually at a temperature well below the freezing temperature of water, there is a noticeable ice and moisture buildup on the air tower when the product is run in humid conditions. This moisture buildup is due to the fact that moisture from the atmosphere is attracted to the coldest surfaces in the two compartments, such as the evaporator cover and the air tower.

In order to remove ice build up in the freezer compartment, it is known to utilize defrost cycles in which a heater is used to warm the area, particularly associated with the evaporator, at various intervals, such as described in U.S. Pat. No. 3,727,419, so that the user is not required to periodically deenergize the freezer, remove all of the food items, and allow the ice to melt. However, due to the low thermal conductivity of the plastic material normally used for the air tower, all of the frost and ice build-up is not melted from the tower during defrost cycles. This has lead to a significant number of customer complaints and service calls, to remove the ice build up on the air tower, which can restrict the flow of air into the two compartments, and alter the ratio of cold air flowing to the two compartments, thereby altering the preset temperature differential.

It would be an improvement in the art if air towers were provided with a means of reducing the ice build up associated with the air tower, or to enhance the ice removal during defrost cycles.

SUMMARY OF THE INVENTION

The present invention provides an air tower construction that enhances the ice melting and removal during defrost cycles.

In an embodiment, an air tower is provided for a refrigeration appliance that has a first cooled compartment and a second cooled compartment. The air tower has a diffuser section with a plurality of vent outlets to communicate with the first cooled compartment. A central duct section is defined by walls extending away from the diffuser section. An outlet is located at an end of the central section opposite the diffuser section to communicate with the second cooled compartment. A first heat trap compartment is formed along one of the walls defining the central duct section.

In an embodiment, the first heat trap compartment comprises an enclosed space formed on an exterior of the central duct section.

In an embodiment, the enclosed space comprises an additional wall spaced from one of the walls defining the central vertical duct section, and connected to the one of the walls at a first end and a second end.

In an embodiment, a second heat trap compartment is formed along one of the walls defining the central duct section.

In an embodiment, the second heat trap compartment is formed along one of the walls which is located opposite one of the walls where the first heat trap is formed.

In an embodiment, the walls comprise a front and two sides of the central section, and the first and second heat trap compartments are formed on an outer side of the two sides of the central section.

In an embodiment, the refrigeration appliance may have a freezer compartment located above a fresh food compartment, with the diffuser section communicating with the freezer compartment.

In an embodiment, the refrigeration appliance may be provided with a refrigeration system, including an evaporator and a defroster heater associated with the evaporator.

In an embodiment, the evaporator may attach to a cover for the evaporator.

In an embodiment, the central duct section may be generally vertically arranged.

DETAILED DESCRIPTION OF THE PREFERRED EMBODIMENTS

The present invention has particular utility in connection with a refrigeration appliance in which a freezer compartment is located above a fresh food compartment, although the invention may also be used with other types of refrigeration appliances utilizing an air tower in connection with two refrigerated compartments, whether they are positioned one above the other or side-by-side. In order to present a description of a preferred embodiment of the invention, a top mounted freezer refrigeration appliance is selected as an environment for the invention, even though the invention is not limited to such an appliance.

Figure 1:
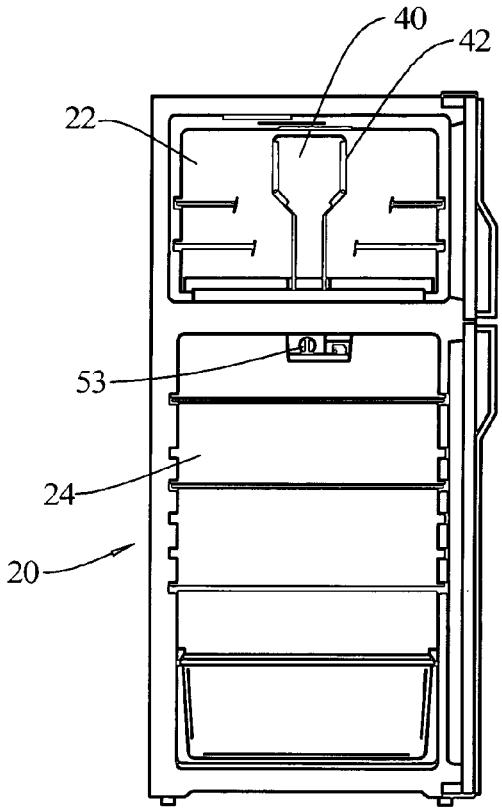
FIG. 1 is a front elevational view of a refrigeration appliance embodying the principles of the present invention.
Figure 2:
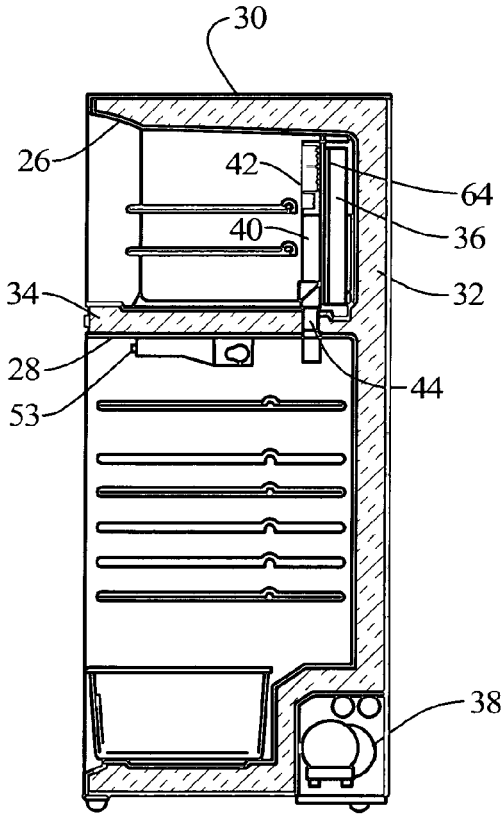
FIG. 2 is a side sectional view of the refrigeration appliance of FIG. 1

In FIGS. 1 and 2 there is illustrated a refrigeration appliance 20 in the form of a top mount refrigerator/freezer appliance including a first cooled compartment 22 which may be a freezer compartment on or above a second cooled compartment 24 which may be a refrigerator or fresh food compartment. The freezer compartment 22 is defined by a liner 26 and the fresh food compartment 24 is defined by a liner 28. These liners 26, 28 are placed within an outer metal shell 30 and the intervening space between the shell 30 and the liners is filled with an insulating foam 32. The insulating foam 32 also extends in a space 34 between the freezer liner 26 and the fresh food liner 28. In other refrigeration appliances, a single liner may define an interior volume which is divided into compartments by a separate dividing wall engaged with the liner.

Cooling within the compartments 22, 24 occurs through the use of a refrigeration system in which a refrigerant is supplied to an evaporator 36 from a compressor 38. Air is directed by a fan (not shown) to flow over the evaporator 36 to cool the air which is then directed into the freezer compartment 22 and refrigerator compartment 24.

The air from the evaporator 36 is discharged into an air tower 40 where the air flow is split into two streams, one stream flowing into the first cooled compartment 22 through vent outlets 42 in a diffuser section 43 of the air tower and the other stream being directed down to the second cooled compartment 24 through a central duct section 44 in the air tower. The central duct section 44 is defined by walls 46, 48, 50 extending away from the diffuser section 43. An outlet 52 is located at an end of the central duct section 44 opposite the diffuser section 43 to communicate with the second cooled compartment 24. Temperature within the second cooled compartment 24 is controlled by an adjustable thermostat (not shown) which can be user adjustable through use of a control knob 53.

Figure 4:
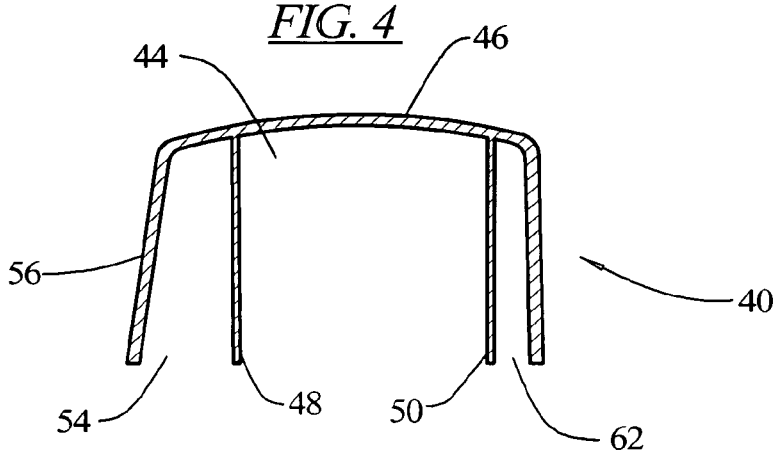
FIG. 4 is a top sectional view taken generally along the line IV-IV of FIG. 3.
Figure 3:
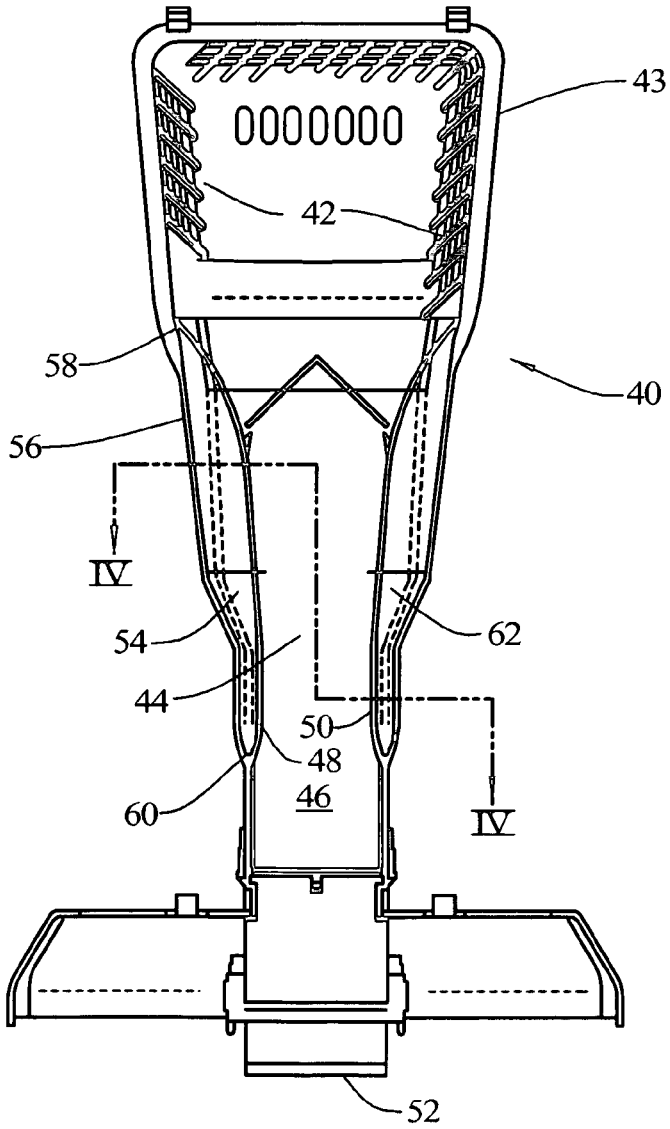
FIG. 3 is a rear elevational view of the air tower embodying the principles of the present invention.

As shown in more detail in FIGS. 3 and 4, in the embodiment illustrated, the walls 46, 48, 50 are shown to be substantially vertical, thus orienting the central duct section 44 substantially vertical, although in other embodiments, they may have a different orientation. A first heat trap compartment 54 is formed along one of the walls 46, 48, 50 defining the central duct section 44. The first heat trap compartment 54 comprises an enclosed space formed on an exterior of the central duct section 44. The enclosed space of the first heat trap compartment 54 comprises an additional wall 56 spaced from one of the walls 46, 48, 50 defining the central duct section 44. This additional wall 56 is connected to the one of the walls 46, 48, 50 at a first end 58 and a second end 60.

A second heat trap compartment 62 may be provided, and as shown, is formed along one of the walls 46, 48, 50 defining the central duct section 44. In the embodiment illustrated, the second heat trap compartment 62 is formed along one of the walls 46, 48, 50 which is located opposite one of the walls where the first heat trap compartment 54 is formed.

In the embodiment illustrated, the walls 46, 48, 50 comprise a front and two sides of the central duct section 44, and the first 54 and second 62 heat trap compartments are formed on an outer side of the two sides 48, 50 of the central duct section. Alternatively, the first heat trap compartment 54 may be formed internally in the central duct section 44 such as along the front wall 46 rather than at an outside of one of the walls 46, 48, 50 defining the central duct section.

The refrigeration appliance 20 may be provided with a defroster heater 64 (FIG. 2) associated with the evaporator 36. The evaporator 36 may be separated from one of the two refrigeration compartments 22, 24 by a cover 66. The cover 66 may be a separate part attached to the refrigeration compartment 22, 24, or may be a portion of the liner 26, 28 of the compartment.

Figure 5:
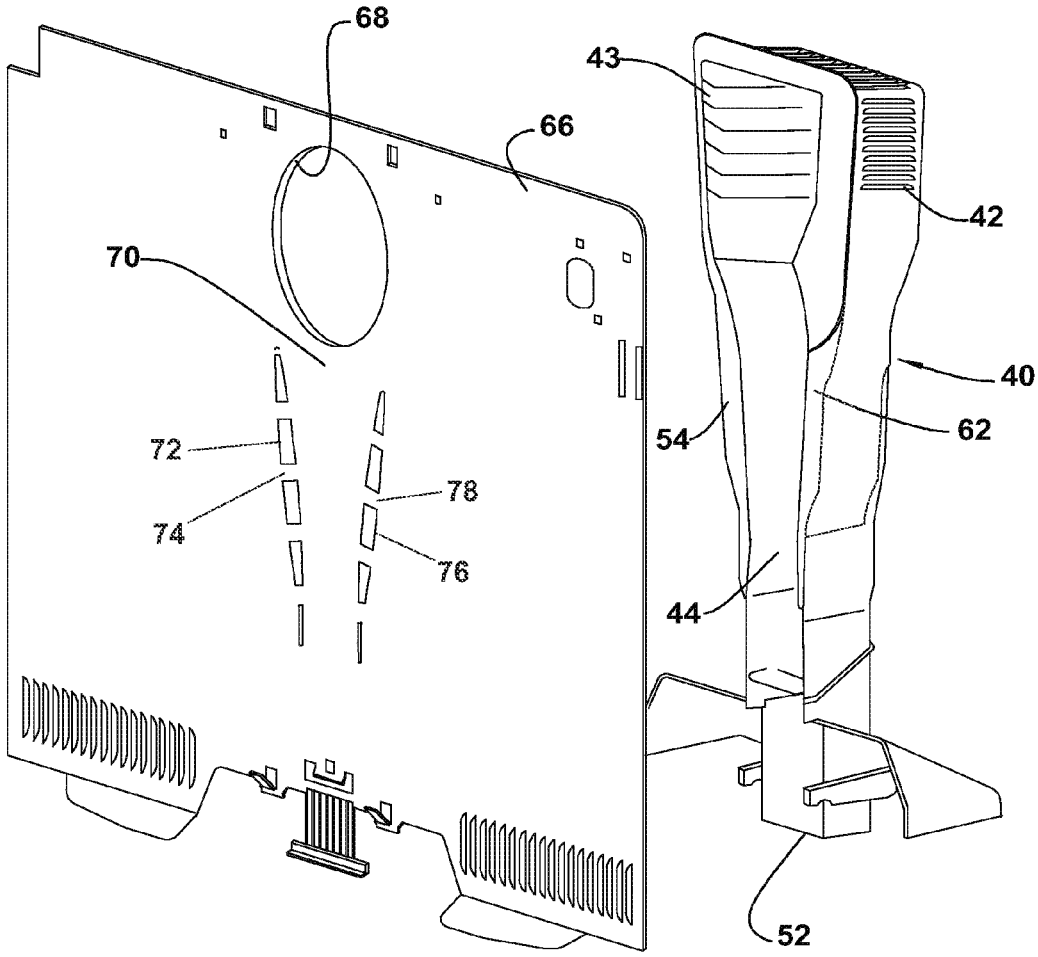
FIG. 5 is an exploded perspective view of the air tower and evaporator cover embodying the principles of the present invention.

In the embodiment illustrated, the air tower 40 is attached to the cover 66 for the evaporator 36. The evaporator cover has an opening 68 therethrough in a region 70 corresponding to the diffuser section 43 . As illustrated in FIG. 5, the evaporator cover 66 has at least one passage 72 therethrough in a region 74 corresponding to the first heat trap compartment 54 and at least one passage 76 therethrough in a region 78 corresponding to the second heat trap compartment 62. As illustrated, the passages 72, 76 may comprise a plurality of passages providing communication between an area heated by the defrost heater 64 and the first 54 and second 62 heat trap compartments.

During operation of the refrigeration appliance 20, and particularly during a defrost cycle, the defrost heater 64 will be energized to elevate the temperature of the evaporator 36 above the freezing temperature of water. Part of the heated air will flow through the air tower 40 to melt and remove any ice that has formed in the air tower. To enhance the ice melting and removal in the air tower 40, some heat flows via air currents through the passages 72, 76 in the evaporator cover 66 into the heat trap compartments 54, 62. The heat trapped inside of the side compartments 54, 62 will conduct to the central duct section 44, which will assist in melting any ice located there.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in to limit the scope and coverage of the invention. The scope of the invention is therefore to be limited only by the appended claims.

As is apparent from the foregoing specification, the invention is susceptible of bodied with various alterations and modifications which may differ particularly from at have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigeration appliance comprising:

a freezer compartment;

a fresh food compartment;

a refrigeration system, including an evaporator;

an evaporator cover positioned between said evaporator and said freezer compartments having a first passage for discharging air cooled by the evaporator;

a defrost heater associated with said evaporator;

an air tower attached to said evaporator cover receiving cooled air discharged from the evaporator through said first passage, said air tower having a diffuser section overlying said first passage and having a plurality of vent outlets positioned in said freezer compartment for directing cooled air into said freezer compartment, a central vertical duct section defined by substantially vertical walls comprising a front wall and first and second side walls extending from said diffuser section for directing cooled air toward said fresh food compartment, an outlet at an end of said central vertical duct section opposite said diffuser section to communicate with said fresh food compartment, and a first heat trap compartment formed along said first side wall defining said central vertical duct section comprising a first additional wall spaced from said first side wall and connected to said first side wall at a first and second end forming a first enclosed space on the exterior of said central vertical duct section on said first side wall, wherein said evaporator cover has at least one second passage therethrough in a region corresponding to said first heat trap compartment to allow heat to flow into the first heat trap compartment from the defrost heater.

2. A refrigeration appliance according to claim 1, including a second heat trap compartment formed along said second side wall defining said central vertical duct section comprising a second additional wall spaced from said second side wall and connected to said second side wall at a first and second end forming a second enclosed space formed on the exterior of said central vertical duct section on said second side wall, wherein said evaporator cover has at least one third passage therethrough in a region corresponding to said second heat trap compartment to allow heat to flow into the second heat trap compartment from the defrost heater.

3. A refrigeration appliance according to claim 2, wherein said evaporator cover has plural passages therethrough in the regions corresponding to said first heat trap compartment and said second heat trap compartment.

4. A refrigeration appliance according to claim 1, wherein said outlet is at a bottom end of said central vertical duct section.

* * * * *